US005190256A

United States Patent [19]

Macchiarella

[11] Patent Number: 5,190,256

[45] Date of Patent: Mar. 2, 1993

[54] CAMERA SUPPORT FOR TRACKING TOWED OBJECT

[76] Inventor: John T. Macchiarella, 146 Vega Rd., Watsonville, Calif. 95076

[21] Appl. No.: 640,637

[22] Filed: Jan. 14, 1991

[51] Int. Cl.[5] ..... F16M 13/00

[52] U.S. Cl. ..... 248/229; 114/253; 248/278; 352/53; 352/243

[58] Field of Search ..... 248/229, 183, 278; 354/81; 352/53, 243; 114/253, 254

[56] References Cited

U.S. PATENT DOCUMENTS

| | | | |
|---|---|---|---|
| 3,180,603 | 4/1965 | O'Connor | 248/183 |
| 3,484,066 | 12/1969 | Aunspaugh | 248/229 X |
| 3,838,660 | 10/1974 | Frisbee | 114/253 X |
| 4,177,595 | 12/1979 | Chon | 248/183 X |
| 4,498,744 | 2/1985 | Ealovega et al. | 352/243 X |
| 4,579,434 | 4/1986 | Grigg | 354/81 |
| 4,617,572 | 10/1986 | Hugo | 248/183 X |
| 4,641,597 | 2/1987 | Paxton | 114/253 |
| 4,893,577 | 1/1990 | Jennings | 114/253 |

*Primary Examiner*—David L. Talbott
*Attorney, Agent, or Firm*—Jack W. Edwards

[57] ABSTRACT

A support for mounting a camcorder, a motion picture camera, or the like on a boat mounted pylon holding a tow rope to an object such as a water skier automatically tracks movement of the water skier. A clamp fastens to the pylon and holds a rod extending upwardly offset from the pylon. A turning stand is mounted for panning rotation above the rod. A platform is pivotally mounted for tilting on the turning stand and can rotate with the turning stand. The platform is located at a level above the pylon. A guidance arm extends rigidly from the platform over the tow rope in an axial direction for attachment thereto at a location spaced from the pylon. The platform can pan in response to lateral movement of the tow rope.

7 Claims, 1 Drawing Sheet

CAMERA SUPPORT FOR TRACKING TOWED OBJECT

BACKGROUND OF THE INVENTION

1. Field of the Invention

This invention relates to a support for a camera, such as a camcorder or a motion picture camera, that automatically tracks a towed object, such as a water skier or the like. More specifically, the camera support fastens to a boat mounted pylon holding a tow rope, and the support attaches to the tow rope for tracking guidance.

2. Description of the Prior Art

It is desirable to record the movement of a towed object, such as a water skier, with a camcorder or a motion picture camera for both entertainment and subsequent review to improve the water skier's technique for competition. Water skiers move back and forth across the wake of the boat from which they are towed. In tournament slalom competition, the boat moves between two rows of buoys and the competitor skis around buoys on alternate sides of the wake. The tow rope is shortened after each pass and as the rope gets shorter, the skier moves faster from one side to the other. Keeping a camera aimed at the water skier can be a problem because of rapid movement of the skier, boat movement affecting balance of the camera operator, and sometimes the only person available in the boat for operating the camera must also operate the boat. There is a need for a boat mounted camera support that automatically tracks a towed object such as a water skier.

Power boats used to pull water skiers are commonly equipped with a pylon which provides an anchor point for attaching a two rope. The pylon is a vertical post, located near the center of gravity of the boat. It mounts to the deck and extends to a level so that attachment of a tow rope gives a skier enhanced mobility.

SUMMARY OF THE INVENTION

An object of the present invention is to provide a camera support for automatically tracking a towed object, such as a water skier.

Another object of the invention is to provide a camera support that can pan in response to lateral movement of a tow rope.

A further object of the invention is to provide a camera support that fastens to a pylon holding a tow rope to a towed object, such as a water skier, and that attaches to the tow rope for guidance in tracking movement of the water skier.

A camera support fastenable to a boat mounted pylon holding a tow rope to a towed object is operable to automatically track movement of the towed object. The support has stationary means for attachment to the pylon and for positioning the support. A turning stand is mounted for panning rotation above the stationary means. A platform is pivotally mounted for tilting on the turning stand and rotatable with the turning stand. A guidance arm extends rigidly from the platform over the tow rope in an axial direction for attachment thereto at a location spaced from the pylon. The platform can pan in response to lateral movement of the tow rope.

Advantages of the invention include the ability to automatically track a towed object, such as a water skier, with a camera support that can pan in response to lateral movement of a tow rope. The camera support is fastenable to a pylon holding the tow rope and attaches to the tow rope for tracking guidance.

These and other objects and advantages of the present invention will no doubt become obvious to those of ordinary skill in the art after having read the following detailed description of the preferred embodiment which is illustrated in the various drawing figures.

DESCRIPTION OF THE PREFERRED EMBODIMENT

Figure 1:
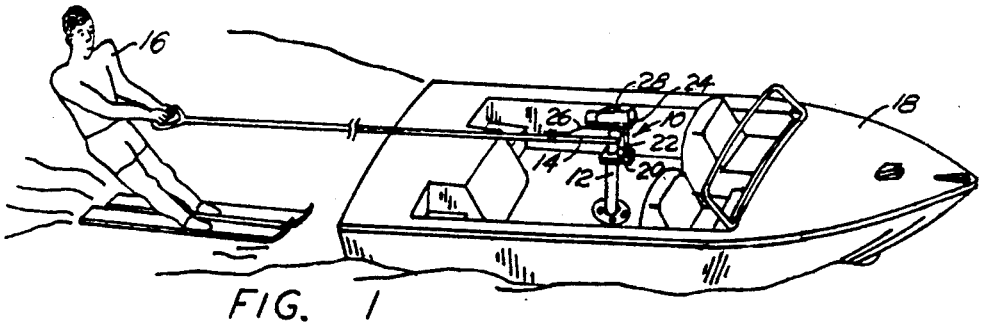
FIG. 1 is a perspective view illustrating a water ski boat equipped with a pylon having mounted thereon a camera support embodying the present invention.

Looking now at FIG. 1, a camera support, indicated by general reference numeral 10, is shown fastened to a pylon 12 holding a tow rope 14 to a towed object such as a water skier 16. Other towed objects might include a person riding in an inner tube or on a water sled. The pylon is mounted on a power boat 18 for towing the water skier. The camera support includes a clamp 20 that fastens to the pylon and holds a rod 22 extending upwardly from the clamp offset from the pylon. The clamp and the rod are stationary means for attachment and positioning. Mounted above the rod is a platform 24 having a guidance arm 26 extending therefrom for attachment to the tow rope. A camera 28, such as a camcorder for recording video pictures on tape or a motion picture camera for recording pictures on film, is held by the platform.

Figure 2:
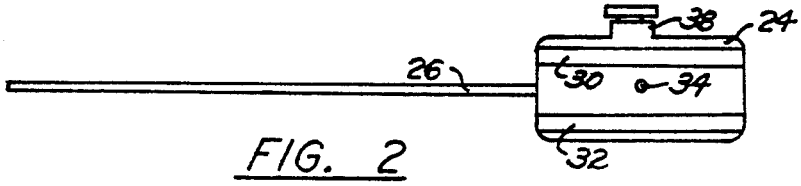
FIG. 2 is a top plan view of a platform and guidance arm for the camera support shown in FIG. 1.
Figure 4:
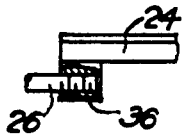
FIG. 4 is an enlarged detail view with portions broken away to show underlying structure of the connection between the guidance arm and the platform.
Figure 3:
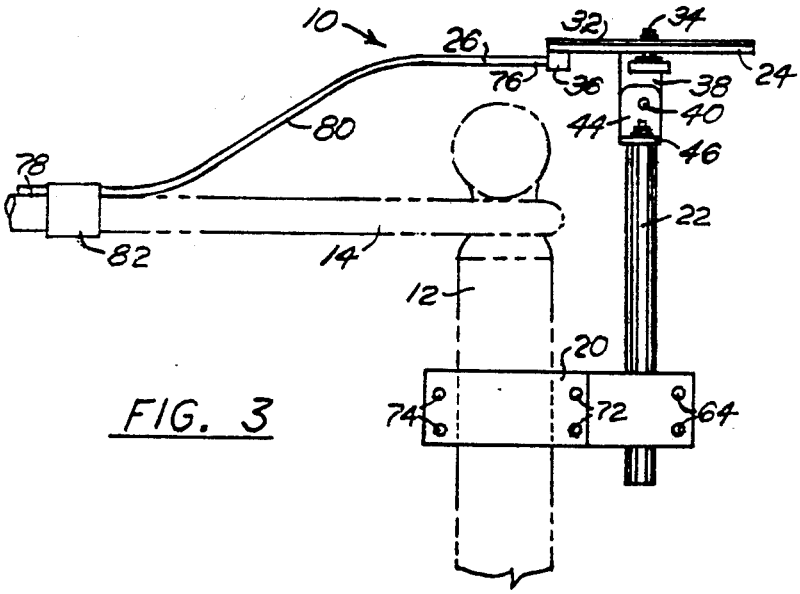
FIG. 3 is a side elevation view of the camera support with a pylon and a tow rope shown in phantom line.
Figure 5:
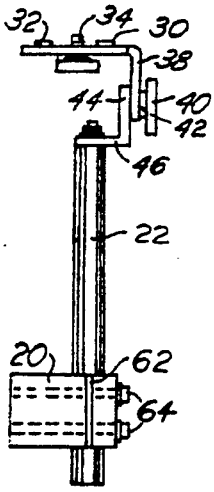
FIG. 5 is an end view of the camera support shown in FIG. 3.
Figure 6:
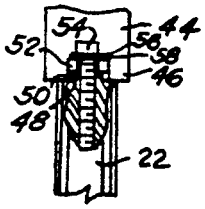
FIG. 6 is an enlarged detail view with portions broken away to show underlying structure of the connection between a turning stand and a stationary rod.
Figure 7:
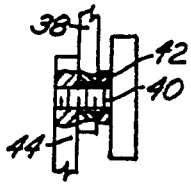
FIG. 7 is an enlarged detail view with portions broken away to show underlying structure of the connection between the turning stand and a platform.

With reference to FIG. 2, a pair of sponge rubber strips 30 and 32 are provided on the top of the platform 24 for supporting the camera. A mounting bolt 34 extends through the platform for attachment to the camera. An internally threaded sleeve 36, shown in FIGS. 3 and 4, is welded to the bottom of the platform and receives the threaded end of the guidance arm 26. The platform has a depending leg 38 that is pivotally mounted for tilting about a bolt 40, shown in FIGS. 3, 5 and 7. The leg is frictionally held between a washer 42 and an upright leg 44 of a turning stand 46. The turning stand is mounted for panning rotation above the rod 22 which has a stepped end 48, as shown in FIG. 6. A bushing 50, fixed within a bore in the turning stand, fits snugly about the stepped end of the rod. A removable bushing 52 fits over the fixed bushing and the stepped end. A bolt 54 and a pair of washers 56 and 58 hold the turning stand in place at the stepped end of the rod.

Figure 8:
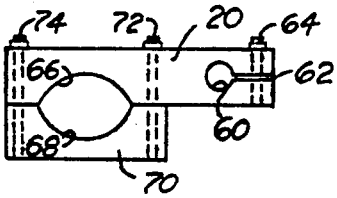
FIG. 8 is a top plan view of a clamp for mounting the support to a pylon.

As shown in FIG. 8, a clamp 20 has an opening 60 for receiving the rod 22. A slot 62 extends from the opening to an adjacent end of the clamp. A pair of bolts 64 extend through the split clamp portions transversely of the slot for tightening the opening about the rod. The clamp has a grooved surface 66 adapted to fit about one half of the pylon 12, and a similar grooved surface 68 is provided in a block 70 adjustably held thereto by bolts 72 and 74.

Looking again at FIG. 3, the clamp 20 is fastened to the pylon 12 at a location below the tow rope 14. The rod 22 is positioned to hold the platform 24 at a level above the pylon and the tow rope. The guidance arm 26 extends rigidly from the platform in a direction axially over the tow rope. A first portion 76 of the arm extends parallel with the platform, a second portion 78 of the arm extends parallel with the tow rope, and an inclined portion 80 of the arm is bent between the first and second portions. The second portion of the arm is attached to the tow rope by a binding 82, such as a strip of Velcro tape. The camera 28, shown in FIG. 1, is attached to the platform by the mounting bolt 34.

In operation, the camera 28 can be focused on the water skier 16 for the outstanding length of tow rope 14. Then the camera can be started and as the water skier moves back and forth laterally across the wake of the boat, the camera support 10 will automatically track the water skier so long as the tow rope remains taut.

In view of the foregoing description, it will be seen that the camera support 10 is fastenable to a boat mounted pylon 12 holding a tow rope 14 to a towed object such as a water skier 16 for automatically tracking movement of the water skier. The support has stationary means 20, 22 for attachment to the pylon and for positioning the support. A turning stand 46 is mounted for panning rotation above the stationary means. A platform 24 is pivotally mounted for tilting on the turning stand and rotatable with the turning stand. A guidance arm 26 extends rigidly from the platform over the tow rope in an axial direction for attachment thereto by a binding 82 at a location spaced from the pylon. The platform can pan in response to lateral movement of the tow rope.

Although the present invention has been described in terms of the presently preferred embodiment, it is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A camera support fastenable to a boat mounted pylon holding a tow rope to a towed object and operable to automatically track movement of the towed object, said support comprising:

stationary means for attachment to the pylon and for positioning the support, a turning stand mounted for panning rotation above the stationary means, a platform pivotally mounted for tilting on the turning stand and rotatable therewith, and a guidance arm extending rigidly from the platform over the tow rope in an axial direction for attachment thereto at a location spaced from the pylon so that the arm and the tow rope move together laterally at the point of attachment.

2. A support for mounting a camcorder or the like on a boat mounted pylon holding a tow rope to a water borne object the movement of which can be automatically tracked by the support, said support comprising:

means for fastening the support to the pylon, positioning means extending upwardly from the fastening means and offset from the pylon, a turning stand mounted for panning rotation above the positioning means, a platform pivotally mounted for tilting on the turning stand and rotatable therewith, said platform being located at a level above the pylon and adapted for holding the camcorder, a guidance arm extending rigidly from the platform over the tow rope in an axial direction for attachment thereto at a location spaced from the pylon, whereby the platform can pan in response to lateral movement of the tow rope.

3. A support for mounting a motion picture camera or the like on a boat mounted pylon holding a tow rope to a towed object so that movement of the towed object can be automatically tracked, said support comprising:

a clamp for fastening to the pylon, a rod extending upwardly from the clamp and offset from the pylon, a turning stand mounted for panning rotation above the rod, a platform pivotally mounted for tilting on the turning stand and rotatable therewith, and a guidance arm extending rigidly from the platform over the tow rope in an axial direction for attachment thereto at a location spaced from the pylon, whereby the platform can pan in response to lateral movement of the tow rope.

4. The camera support of claim 1 wherein said guidance arm has a first portion extending parallel with the platform portion, a second portion extending parallel with the tow rope, and an inclined portion bent between the first portion and the second portion.

5. The camera support of claim 1 wherein said guidance arm is attached to the tow rope by a binding.

6. The camera support of claim 1 wherein said pivotal mounting for tilting on the turning stand is frictionally adjustable to compensate for dead weight.

7. A camera support fastenable to a boat mounted pylon that holds a tow rope to a towed object, said support being operable to automatically track movement of the towed object, said support comprising:

means for attaching the support to the pylon, a turning stand held in place by said support attaching means, said turning stand being mounted for panning rotation, means for mounting a camera above the turning stand for panning rotation therewith, and a guidance arm for causing panning rotation of the camera mounting means and turning stand in response to lateral movement of the tow rope at a location spaced from the pylon.

* * * * *